US011328595B1

(12) United States Patent
You et al.

(10) Patent No.: US 11,328,595 B1
(45) Date of Patent: May 10, 2022

(54) PARKING RECOGNITION SERVER FOR PERSONAL MOBILITY DEVICE, SYSTEM INCLUDING THE SAME, AND METHOD THEREOF

(71) Applicants: HYUNDAI MOTOR COMPANY, Seoul (KR); KIA CORPORATION, Seoul (KR)

(72) Inventors: Kyung Jin You, Anyang-si (KR); So Jeong Kim, Seoul (KR); Na Hyeon Pak, Anyang-si (KR)

(73) Assignees: HYUNDAI MOTOR COMPANY, Seoul (KR); KIA CORPORATION, Seoul (KR)

( * ) Notice: Subject to any disclaimer, the term of this patent is extended or adjusted under 35 U.S.C. 154(b) by 0 days.

(21) Appl. No.: 17/348,502

(22) Filed: Jun. 15, 2021

(30) Foreign Application Priority Data

Nov. 26, 2020 (KR) ..... 10-2020-0161688

(51) Int. Cl.
*G08G 1/14* (2006.01)
*G08G 1/01* (2006.01)

(52) U.S. Cl.
CPC ..... *G08G 1/142* (2013.01); *G08G 1/0108* (2013.01); *G08G 1/0129* (2013.01); *G08G 1/146* (2013.01); *G08G 1/148* (2013.01)

(58) Field of Classification Search
None
See application file for complete search history.

(56) References Cited

U.S. PATENT DOCUMENTS

| | | | | |
|---|---|---|---|---|
| 10,036,639 | B1 * | 7/2018 | Cox | G01C 21/28 |
| 2012/0319597 | A1 * | 12/2012 | Park | H05B 47/125 315/154 |
| 2014/0052374 | A1 * | 2/2014 | Hoch | G01C 21/343 701/533 |
| 2019/0147368 | A1 * | 5/2019 | Pinel | G06N 5/022 706/12 |
| 2020/0005642 | A1 * | 1/2020 | Kim | H04W 4/90 |
| 2020/0012281 | A1 * | 1/2020 | Jaegal | B60W 50/023 |
| 2020/0143682 | A1 * | 5/2020 | Chow | G08G 1/0112 |
| 2020/0327179 | A1 * | 10/2020 | Matsumoto | G01C 21/3679 |

* cited by examiner

*Primary Examiner* — John F Mortell
(74) *Attorney, Agent, or Firm* — Morgan, Lewis & Bockius LLP

(57) ABSTRACT

A parking recognition server of a personal mobility device and a method thereof are provided. The parking recognition server includes a processor configured to determine whether a personal mobility device is parked in a parking area, and a storage configured to store data and an algorithm run by the processor and a usage history for each user who uses the personal mobility device. The processor may be further configured to predict a destination and a movement path of a user for the usage history for each user, and determine a device candidate group having a high probability of being parked in the predicted destination based on a degree of overlap between the predicted movement path and an actual movement path of the user.

20 Claims, 12 Drawing Sheets

PARKING RECOGNITION SERVER FOR PERSONAL MOBILITY DEVICE, SYSTEM INCLUDING THE SAME, AND METHOD THEREOF

CROSS-REFERENCE TO RELATED APPLICATION

This application claims the priority to and the benefit of Korean Patent Application No. 10-2020-0161688, filed on Nov. 26, 2020, the entire contents of which are incorporated herein by reference.

TECHNICAL FIELD

The present disclosure relates to a parking recognition server for a personal mobility device and a method thereof.

BACKGROUND

Personal mobility is personal transportation powered by electricity, and an electric kickboard, an electric wheel, an electric bicycle, an ultra-small electric vehicle, and the like correspond to it. Under the Korean Road Traffic Act, because motors with an engine displacement of less than 50 cc (electric power is less than the rated output power of 0.59 kw or 590 w) such as electric kickboards and electric wheels correspond to 'motor bicycles', users must have the motorcycle license (which can be acquired from 16 years of age or older).

The personal mobility has been provided as a service of shared personal mobility to the populace. Recently, shared personal mobility business has been greatly expanded. It is able to see personal mobility without difficulty on the street.

As such, recently, there has been an increase in use of last mile mobility. However, users' awareness of proper parking culture is insufficient, and the technical method borrowed for efficient service operation by operators is not effective. In other words, a reward system according to return locations is provided to create the right parking culture awareness of users, but it is determined depending on only global positioning system (GPS) information such as user locations or device locations, each of which has a larger error range, it is unclear to determine whether accurately parking is performed.

Furthermore, in an existing technology, because it is difficult to recognize parking within a close radius using simple sensor recognition and because it is able to recognize only the degree of being nearby, it may be undesirable to determine whether parking is completed in a narrow parking area.

SUMMARY

An aspect of the present disclosure provides a parking recognition server for a personal mobility device for determining an accurate parking location of the personal mobility device and automatically returning the personal mobility device to efficiently manage parking of the personal mobility device and a method thereof.

Another aspect of the present disclosure provides a parking recognition server for a personal mobility device for predicting a destination and a movement path based on a history for each user of the personal mobility device and pre-booking parking in a parking lot of the predicted destination based on the predicted destination and the predicted movement path to facilitate smooth parking and increase convenience of a user and a method thereof.

The technical problems to be solved by the present disclosure are not limited to the aforementioned problems, and any other technical problems not mentioned herein will be clearly understood from the following description by those skilled in the art to which the present disclosure pertains.

According to an aspect of the present disclosure, a parking recognition server may include a processor that determines whether a personal mobility device is parked in a parking area and a storage storing data and an algorithm run by the processor and a usage history for each user who uses the personal mobility device. The processor may predict a destination and a movement path of a user for the usage history for each user and may determine a device candidate group having a high probability of being parked in the predicted destination based on a degree of overlap between the predicted movement path and a real movement path of the user.

In one form of the present disclosure, the parking recognition server may further include a communication device that communicates with a user terminal, a parking lot server, or the personal mobility device.

In one form of the present disclosure, the processor may collect at least one of information about the user, information about a main use time of the user, starting point or destination search information of the user, or information about a main use path of the user, when the personal mobility device is traveling, and may reflect the collected information in the usage history for each user.

In one form of the present disclosure, the processor may compare a main movement path of the user in a main use time zone of the user in the usage history for each user with the real movement path of the user and may determine the personal mobility device as a device having a high probability of being parked in the predicted destination when a degree of overlap between the main movement path and the real movement path is greater than or equal to a predetermined threshold.

In one form of the present disclosure, the processor may perform an automatic parking booking in a parking lot around the predicted destination, when the personal mobility device is determined as the device having the high probability of being parked in the predicted destination.

In one form of the present disclosure, the processor may determine whether there is a parking lot around the predicted destination, when the personal mobility device is determined as the device having the high probability of being parked in the predicted destination, may determine whether there is a parking possible space in the parking lot around the predicted destination, when there is the parking lot around the predicted destination, and may provide a user terminal or the personal mobility device with an automatic booking guide, when there is the parking possible space.

In one form of the present disclosure, the processor may determine a location of the personal mobility device using a location of a device having a high probability of being parked in the predicted destination, a location of a user terminal received from the user terminal of the user who is using the personal mobility device, a location of the personal mobility device received from the personal mobility device, or a location of the personal mobility device which enters a parking lot, the location being received from a parking lot server.

In one form of the present disclosure, the processor may compare the location of the device having the high probability of being parked in the predicted destination, the location of the user terminal received from the user terminal of the user who is using the personal mobility device, the location of the personal mobility device received from the personal mobility device, and the location of the personal mobility device which enters the parking lot, the location being received from the parking lot server, and may determine that the personal mobility device is normally parked in a parking area of the parking lot, when an error is less than a predetermined reference value.

In one form of the present disclosure, the processor may automatically return the personal mobility device, when it is determined that the personal mobility device is normally parked in a parking area of a parking lot.

In one form of the present disclosure, the processor may determine whether a personal mobility device is a device, parking of which is pre-booked in a parking lot in a corresponding time, when receiving information of the personal mobility device which enters the parking lot from a parking lot server.

In one form of the present disclosure, the processor may determine whether the personal mobility device is traveling, whether the user alights from the personal mobility device, or whether the personal mobility device waits for parking.

In one form of the present disclosure, the processor may determine a state of the personal mobility device based on at least one of a speed, a load, a sound detection result, and global positioning system (GPS) location information of the personal mobility device.

In one form of the present disclosure, the processor may determine whether the personal mobility device is traveling or is in a parked state based on acceleration or deceleration of the personal mobility device, may determine whether the user rides or alights from the personal mobility device depending on a time when a load of the personal mobility device is reduced or depending on whether a location of a user terminal and a location of the personal mobility device are identical to each other, and may determine whether the user alights from the personal mobility device depending on whether an alighting alarm sound of the personal mobility device is output.

In one form of the present disclosure, the processor may provide a user terminal or the personal mobility device with parking waiting notification feedback, when it is determined that the personal mobility device waits for parking.

According to another aspect of the present disclosure, a parking recognition system may include a personal mobile device, a user terminal of a user who is using the personal mobility device, a parking lot server that detects that the personal mobility device enters a parking lot, and a parking recognition server that predicts a destination and a movement path of the user for a usage history for each user and determines a device candidate group having a high probability of being parked in the predicted destination based on a degree of overlap between the predicted movement path and a real movement path of the user. The parking recognition server may determine a location of the personal mobility device using a location of a device having a high probability of being parked in the predicted destination, a location of the user terminal received from the user terminal, a location of the personal mobility device received from the personal mobility device, or a location of the personal mobility device which enters a parking lot, the location being received from the parking lot server.

According to another aspect of the present disclosure, a parking recognition method may include predicting a destination and a movement path of a user based on a usage history for each user of a personal mobility device, determining a device candidate group having a high probability of being parked in the predicted destination based on a degree of overlap between the predicted movement path and a real movement path of the user, and determining a location of the personal mobility device using a location of a device having a high probability of being parked in the predicted destination, a location of a user terminal received from the user terminal of the user who is using the personal mobility device, a location of the personal mobility device received from the personal mobility device, or a location of the personal mobility device which enters a parking lot, the location being received from a parking lot server.

In one form of the present disclosure, the parking recognition method may further include collecting at least one of information about the user, information about a main use time of the user, starting point or destination search information of the user, or information about a main use path of the user, when the personal mobility device is traveling, and reflecting the collected information in the usage history for each user.

In one form of the present disclosure, the parking recognition method may further include comparing the location of the device having the high probability of being parked in the predicted destination, the location of the user terminal received from the user terminal of the user who is using the personal mobility device, the location of the personal mobility device received from the personal mobility device, and the location of the personal mobility device which enters the parking lot, the location being received from the parking lot server, and determining that the personal mobility device is normally parked in a parking area of the parking lot, when an error is less than a predetermined reference value.

In one form of the present disclosure, the parking recognition method may further include performing an automatic parking booking in a parking lot around the predicted destination, when the personal mobility device is determined as the device having the high probability of being parked in the predicted destination.

In one form of the present disclosure, the parking recognition method may further include automatically returns the personal mobility device, when it is determined that the personal mobility device is normally parked in a parking area of the parking lot.

DRAWINGS

The above and other objects, features and advantages of the present disclosure will be more apparent from the following detailed description taken in conjunction with the accompanying drawings.

DETAILED DESCRIPTION

Figure 1:
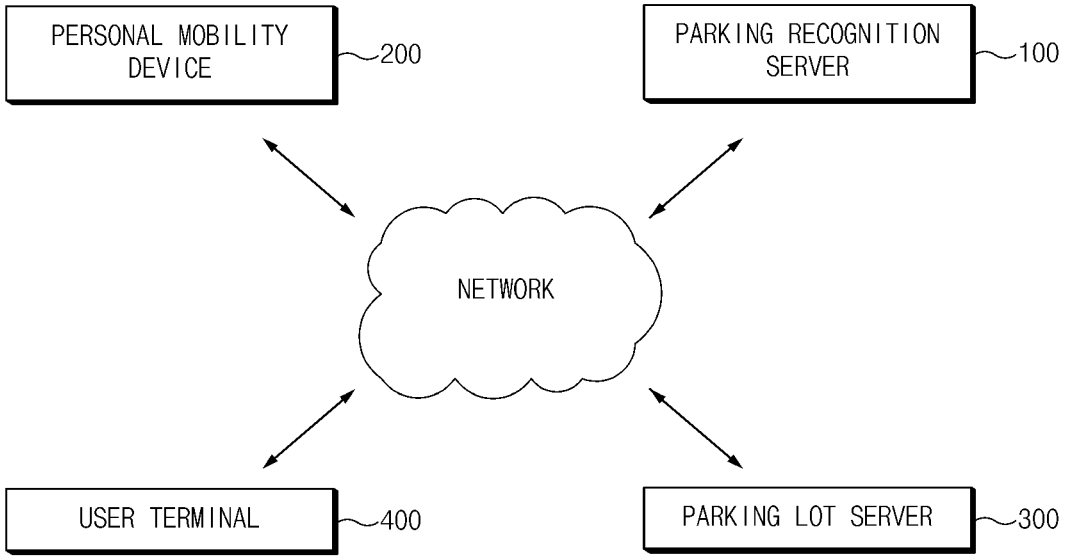
FIG. 1 is a block diagram illustrating a configuration of a parking recognition system for a personal mobility device in some forms of the present disclosure.

Hereinafter, some forms of the present disclosure will be described in detail with reference to the exemplary drawings. In adding the reference numerals to the components of each drawing, it should be noted that the identical or equivalent component is designated by the identical numeral even when they are displayed on other drawings. Further, in describing some forms of the present disclosure, a detailed description of well-known features or functions will be ruled out in order not to unnecessarily obscure the gist of the present disclosure.

In describing some forms of the present disclosure, terms such as first, second, "A", "B", (a), (b), and the like may be used. These terms are merely intended to distinguish one component from another component, and the terms do not limit the nature, sequence or order of the constituent components. Unless otherwise defined, all terms used herein, including technical or scientific terms, have the same meanings as those generally understood by those skilled in the art to which the present disclosure pertains. Such terms as those defined in a generally used dictionary are to be interpreted as having meanings equal to the contextual meanings in the relevant field of art, and are not to be interpreted as having ideal or excessively formal meanings unless clearly defined as having such in the present application.

Hereinafter, forms of the present disclosure will be described in detail with reference to FIGS. 1 to 12.

Figure 2:
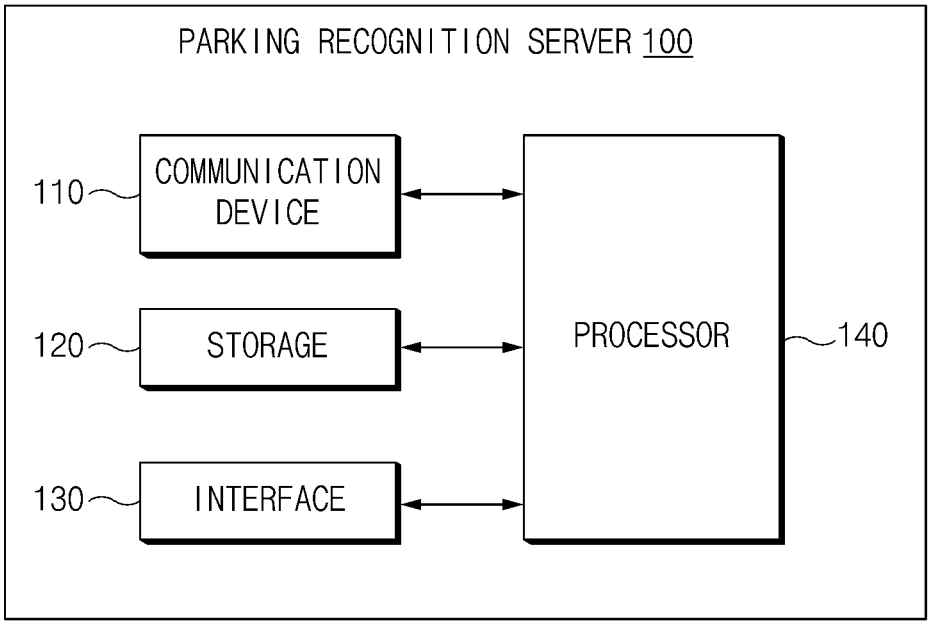
FIG. 2 is a block diagram illustrating a configuration of a parking recognition server in some forms of the present disclosure.

FIG. 1 is a block diagram illustrating a configuration of a parking recognition system for a personal mobility device in some forms of the present disclosure. FIG. 2 is a block diagram illustrating a configuration of a parking recognition server in some forms of the present disclosure.

Referring to FIG. 1, the parking recognition system for the personal mobility device in some forms of the present disclosure may include a parking recognition server 100 for recognizing parking of a personal mobility device 200, the personal mobility device 200, a parking lot server 300, and a user terminal 400.

The parking recognition server 100 may determine whether the personal mobility device 200 is normally parked in a parking area.

The parking recognition server 100 may predict a destination and a movement path of a user based on a usage history for each user, may determine a device candidate group having a high probability of being parked in the predicted destination based on a degree of overlap between the predicted movement path and a real movement path of the user, and may identify an accurate parking location of the personal mobility device 200 based on information received from the personal mobility device 200, the parking lot server 300, and the user terminal 400.

Referring to FIG. 2, the parking recognition server 100 may include a communication device 110, a storage 120, an interface 130, and a processor 140.

The communication device 110 may be a hardware device implemented with various electronic circuits to transmit and receive a signal through a wireless or wired connection, which may communicate with the personal mobility device 200, the parking lot server 300, and the user terminal 400.

Herein, the communication device 110 may perform wired communication or wireless communication. The wireless Internet technology may include wireless local area network (WLAN), wireless broadband (WiBro), wireless-fidelity (Wi-Fi), world interoperability for microwave access (WiMAX), or the like. Furthermore, the short range communication technology may include Bluetooth, ZigBee, ultra wideband (UWB), radio frequency identification (RFID), infrared data association (IrDA), or the like.

As an example, the communication device 110 may receive a device ID and location information from the personal mobility device 200, may receive a device ID of a personal mobility device which enters a parking lot from the parking lot server 300, and may receive location information of the user terminal 400 from the user terminal 400.

The storage 120 may store data, an algorithm, and/or the like necessary for an operation of the processor 140.

As an example, the storage 120 may store collected history information for each user who uses a personal mobility device. In this case, the history information for each user may include user personal information (e.g., contact information, a user name, a nickname, or the like), main use time information for each user, a main use path for each user, starting point/destination search information for each user, or the like.

The storage 120 may include at least one type of storage medium, such as a flash memory type memory, a hard disk type memory, a micro type memory, a card type memory (e.g., a secure digital (SD) card or an extreme digital (XD) card), a random access memory (RAM), a static RAM (SRAM), a read-only memory (ROM), a programmable ROM (PROM), an electrically erasable PROM (EEPROM), a magnetic RAM (MRAM), a magnetic disk, and an optical disk.

The interface 130 may include an input means for receiving a control command from the user and an output means for outputting an operation state, an operation result, or the like of the parking recognition server 100. Herein, the input means may include a key button and may further include a mouse, a joystick, a jog shuttle, a stylus pen, or the like. Furthermore, the input means may further include a soft key implemented on a display. The output means may include the display and may further include a voice output means such as a speaker. In this case, when a touch sensor such as a touch film, a touch sheet, or a touch pad is provided in the display, the display operates as a touchscreen and may be implemented in a form where the input means and the output means are integrated with each other. In this case, the display may include at least one of a liquid crystal display (LCD), a thin film transistor-LCD (TFT-LCD), an organic lightemitting diode (OLED) display, a flexible display, a field emission display (FED), or a three-dimensional (3D) display.

The processor 140 may be electrically connected with the communication device 110, the storage 120, the interface 130, or the like and may electrically control the respective components. The processor 140 may be an electrical circuit which executes instructions of software and may perform a variety of data processing and calculation described below.

The processor 140 may process a signal delivered between the respective components of the parking recognition server 100. The processor 140 may be, for example, a micro controller unit (CPU), or another sub-controller, which is loaded into a computer.

The processor 140 may collect at least one of information about the user, information about a main use time of the user, starting point or destination search information of the user, or information about a main use path of the user, when the personal mobility device 200 is traveling, and may reflect the collected information in a usage history for each user to generate a usage history of the user.

The processor 140 may predict a destination and a movement path of the user based on the usage history for each user and may determine a device candidate group having a high probability of being parked in the predicted destination based on a degree of overlap between the predicted movement path and a real movement path of the user.

In other words, the processor 140 may compare a main movement path of the user in a main use time zone of the user in the usage history for each user with a real movement path of the user. When the degree of overlap between the main movement path and the real movement path is greater than or equal to a predetermined threshold, the processor 140 may determine the personal mobility device 200 as a device having a high probability of being parked in the predicted destination. Thus, when the personal mobility device 200 is determined as the device having the high probability of being parked in the predicted destination, the processor 140 may perform an automatic parking booking in a parking lot around the predicted destination.

When the personal mobility device 200 is determined as the device having the high probability of being parked in the predicted destination, the processor 140 may determine whether there is a parking lot around the predicted destination. When there is the parking lot around the predicted destination, the processor 140 may determine whether there is a paring possible space in the parking lot around the predicted destination. When there is the parking possible space, the processor 140 may provide the user terminal 400 or the personal mobility device 200 with an automatic booking guide.

The processor 140 may determine a location of the personal mobility device 200 using a location of the device having the high probability of being parked in the predicted destination, a location of the user terminal 400 received from the user terminal 400 of the user who is using the personal mobility device 200, a location of the personal mobility device 200 received from the personal mobility device 200, or a location of the personal mobility device 200 which enters a parking lot, which is received from the parking lot server 300.

Figure 5:
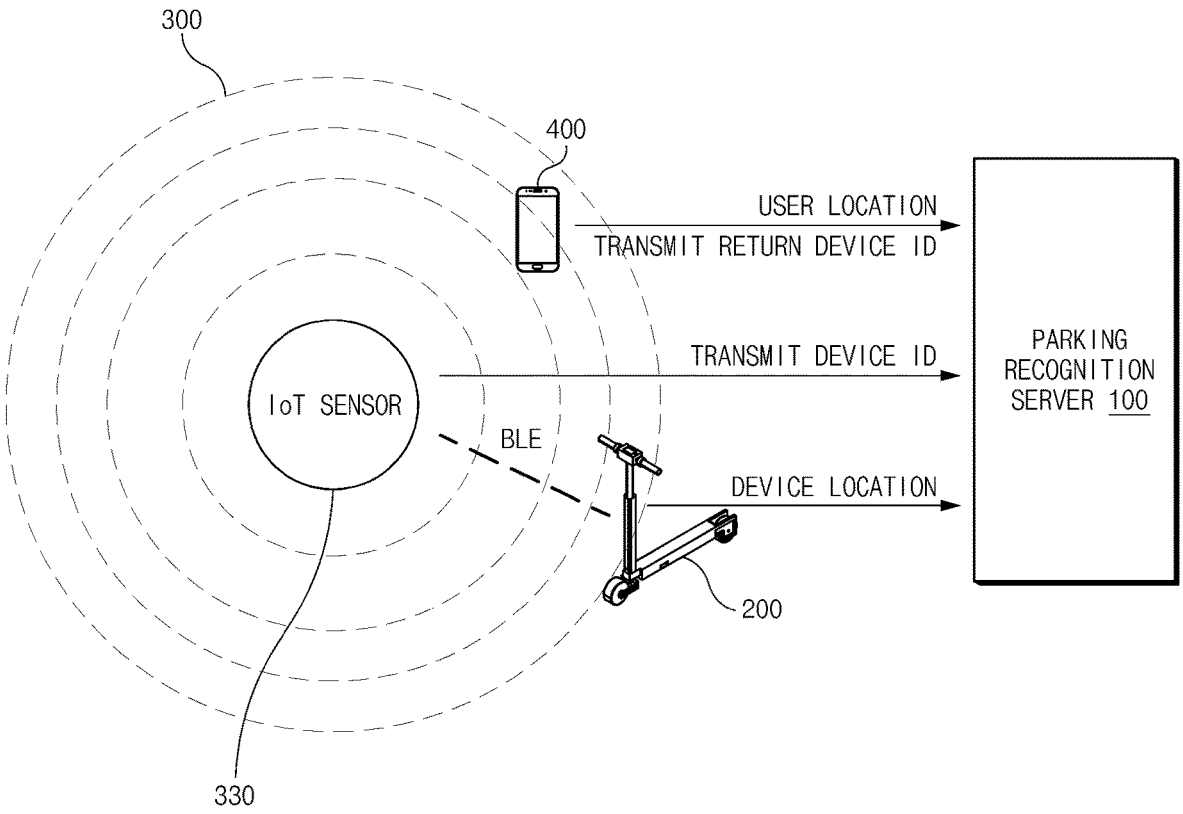
FIG. 5 is a drawing illustrating an exemplary screen where a parking recognition server collects information in some forms of the present disclosure.
Figure 6:
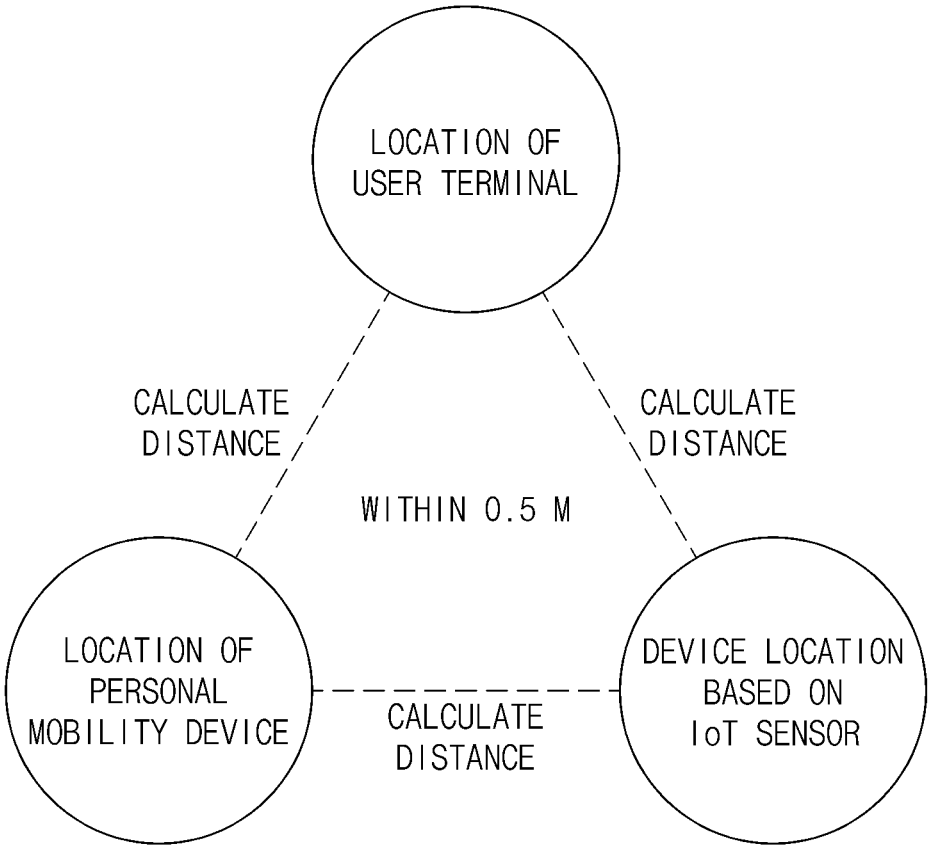
FIG. 6 is a drawing illustrating a process of determining an accurate location of a personal mobility device in a parking area in some forms of the present disclosure.

FIG. 5 is a drawing illustrating an exemplary screen where a parking recognition server collects information in some forms of the present disclosure. FIG. 6 is a drawing illustrating a process of determining an accurate location of a personal mobility device in a parking area in some forms of the present disclosure. As shown in FIG. 5, a parking recognition server 100 of FIG. 1 may collect device ID information and location information from an Internet of things (IoT) sensor 330 of a parking lot server 300 and a personal mobility device 200 and a user terminal 440, which enter within a certain radius with respect to the IoT sensor 330.

Furthermore, as shown in FIG. 6, when a location of a user terminal, a location of a personal mobility device, and device location information received from an IoT sensor are similar to each other, for example, when an error range is less than a predetermined reference value (e.g., 0.5 m), the parking recognition server 100 may determine that the personal mobility device is normally parked in a parking area.

A processor 140 of FIG. 2 may compare a location of a device having a high probability of being parked in the predicted destination, a location of the user terminal received from the user terminal of the user who is using the personal mobility device, a location of the personal mobility device received from the personal mobility device, and a location of the personal mobility device which enters a parking lot, which is received from the parking lot server. When an error is less than a predetermined reference value, the processor 140 may determine that the personal mobility device is normally parked in a parking area of the parking lot.

When it is determined that the personal mobility device is normally parked in the parking area of the parking lot, the processor 140 may automatically return the personal mobility device.

When receiving information of the personal mobility device which enters the parking lot from the parking lot server, the processor 140 may determine whether the personal mobility device is a device, parking of which is pre-booked in the parking lot in a corresponding time.

The processor 140 may determine whether the personal mobility device is traveling, whether the user alights from the personal mobility device, or whether the personal mobility device waits for parking. In other words, the processor 140 may determine a state of the personal mobility device based on at least one of a speed, a load, or a sound sensing result of the personal mobility device.

The processor 140 may determine whether the personal mobility device is traveling or is in a parked state based on acceleration or deceleration of the personal mobility device, may determine a time when a load of the personal mobility device is reduced to determine that the user alights from the personal mobility device, and may determine whether the user alights from the personal mobility device depending on whether the personal mobility device outputs an alighting alarm sound.

When it is determined that the personal mobility device waits for parking, the processor 140 may provide the user terminal or the personal mobility device with parking waiting notification feedback.

Figure 3:
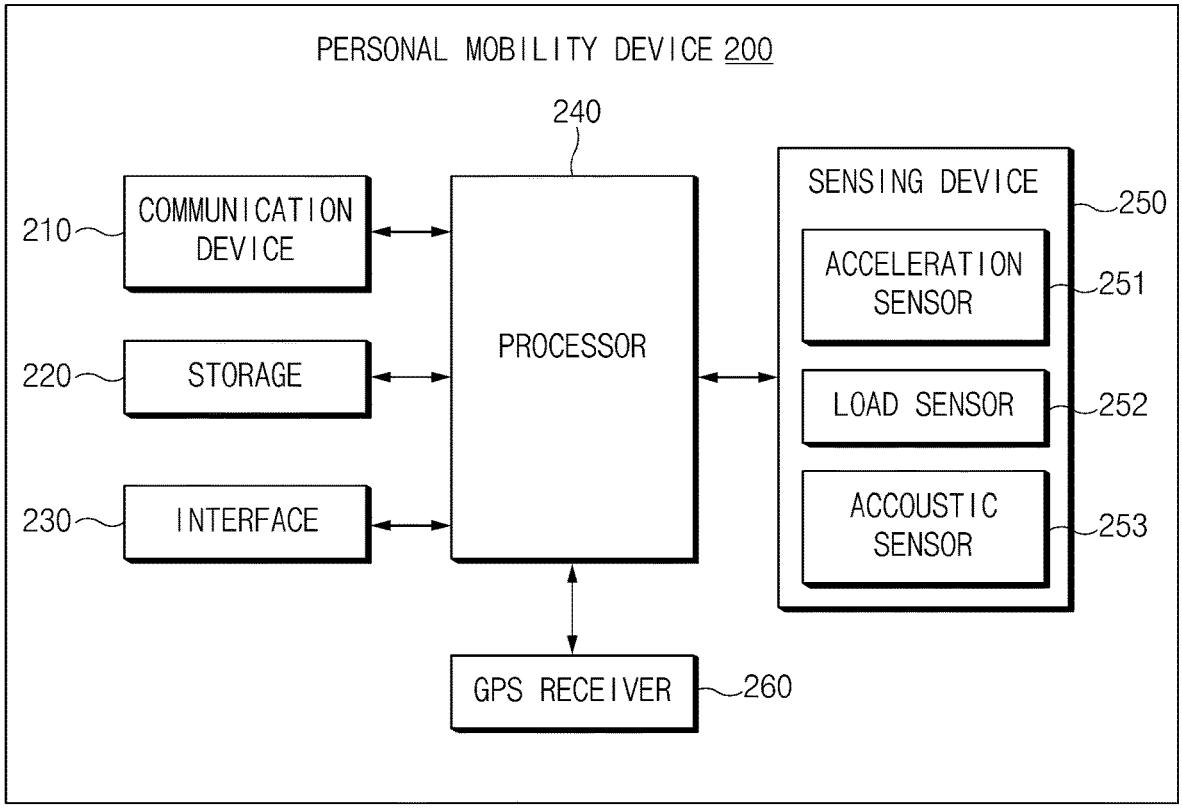
FIG. 3 is a block diagram illustrating a configuration of a personal mobility device in some forms of the present disclosure.

FIG. 3 is a block diagram illustrating a configuration of a personal mobility device 200 in some forms of the present disclosure.

The personal mobility device 200 may be a personal mobility, which may include an electric kickboard, a go-kart, an electric wheel, a scooter, a bicycle, an electric motorcycle, roller skates, an electric wheelchair, or the like.

The personal mobility device 200 may receive global positioning system (GPS) information and may provide a parking recognition server 100 of FIG. 1 with the received GPS information. Furthermore, the personal mobility device 200 may provide the parking recognition server 100 with speed information, load detection information, sound detection information, or the like for detecting that the user rides in the personal mobility device 200, alights from the personal mobility device 200, or waits for parking the personal mobility device 200.

Referring to FIG. 3, the personal mobility device 200 may include a communication device 210, a storage 220, an interface 230, a processor 240, a sensing device 250, and a GPS receiver 260.

The communication device 210 may be a hardware device implemented with various electronic circuits to transmit and receive a signal through a wireless or wired connection, which may communicate with a parking recognition server 100, a parking lot server 300, and a user terminal 400 of FIG. 1.

In this case, the communication device 210 may perform wireless communication and short range communication. The short range communication may include Bluetooth communication. The wireless communication technology is the same as that of the communication device 110 described above.

The storage 220 may store data, an algorithm, and/or the like run by the processor 240. The storage 220 may be implemented as various storage media such as the storage 120 described above.

Figure 7:
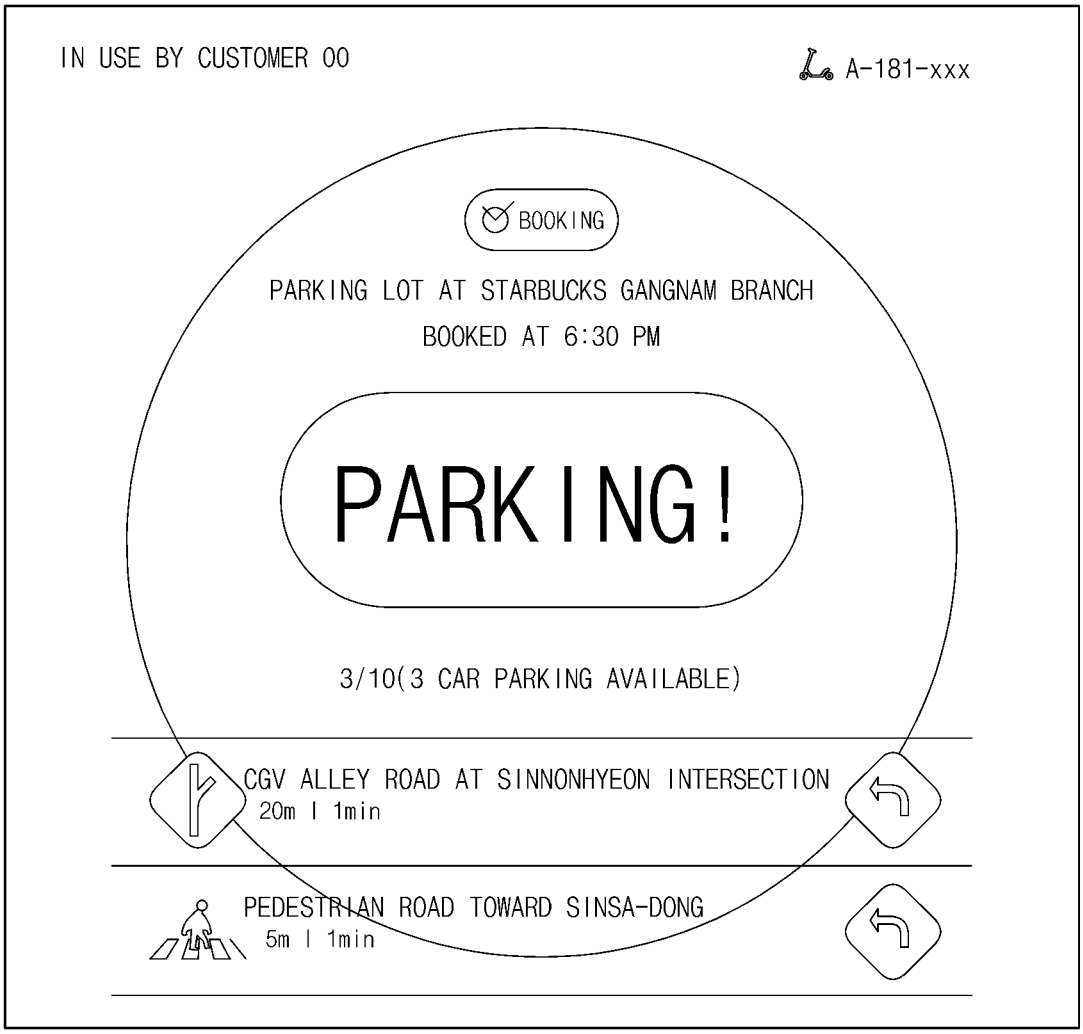
FIG. 7 is a drawing illustrating an exemplary screen where a parking pre-booking is completed, which is displayed on a display of a personal mobility device, in some forms of the present disclosure.

The interface 230 may be implemented as an input means and an output means like the parking recognition server 100. As an example, the output means may output a parking pre-booking state shown in FIG. 7 and may display a current speed, a use time, or the like of the personal mobility device 200. FIG. 7 is a drawing illustrating an exemplary screen where a parking pre-booking is completed, which is displayed on a display of a personal mobility device, in some forms of the present disclosure. As shown in FIG. 7, a personal mobility device 200 of FIG. 3 may display an information guide for parking booking in progress, information about the number of personal mobility devices which are currently parked in a parking lot when close to the parking lot, or the like.

A processor 240 of FIG. 3 may perform the overall control of the personal mobility device 200.

A sensing device 250 of FIG. 3 may include a plurality of sensors for sensing that a user rides or alights from the personal mobility device 200, a speed of the personal mobility device 200, or the like. The sensing device 250 may include an acceleration sensor 251, a load sensor 252, and an acoustic sensor 253. If necessary, the sensing device 250 may further include other sensors.

The acceleration sensor 251 may sense a speed such as acceleration or deceleration of the personal mobility device 200. Thus, a parking recognition server 100 of FIG. 1 may determine whether the personal mobility device 200 waits for parking based on a speed of the personal mobility device 200.

The load sensor 252 may sense a load (pressure) applied to the personal mobility device 200. Such a parking recognition server 100 may determine whether a user rides or alights from the personal mobility device 200 by detecting such a load. Furthermore, when the load sensor 252 is not provided in the personal mobility device 200, the parking recognition server 100 may determine whether the personal mobility device 200 moves above a certain distance immediately before being parked and may determine whether a GPS location of a user terminal 400 of FIG. 1 and a GPS location of the personal mobility device 200 are identical to each other within a certain range. When the GPS location of the user terminal 400 and the GPS location of the personal mobility device 200 are identical to each other, the parking recognition server 100 may determine that the user is riding in the personal mobility device 200.

The acoustic sensor 253 may recognize an alighting alarm sound of the personal mobility device 200 or a voice of the user or a sound around the user. Thus, the parking recognition server 100 may determine whether the user rides or alights from the personal mobility device 200 based on the result of recognizing of the sound of the personal mobility device 200.

Thus, when the personal mobility device 200 decelerates, and when an alighting state and an alighting alarm sound are sensed by the load sensor 252, but when a return sound is not sensed, the parking recognition server 100 may finally determine that the user waits for parking the personal mobility device 200.

The GPS receiver 260 may receive GPS information to obtain location information of the personal mobility device 200.

Figure 4:
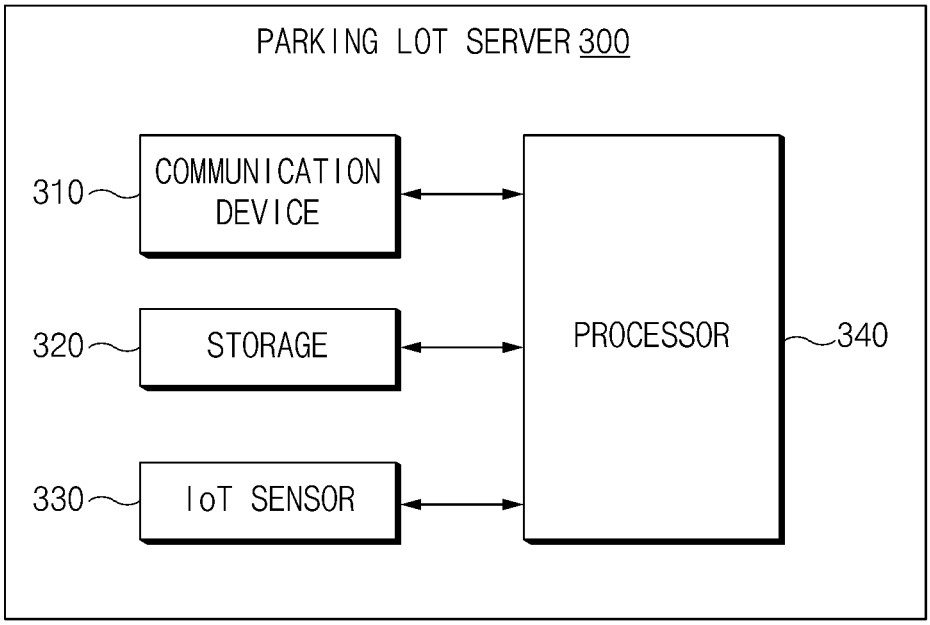
FIG. 4 is a block diagram illustrating a configuration of a parking lot server in some forms of the present disclosure.

FIG. 4 is a block diagram illustrating a configuration of a parking lot server in some forms of the present disclosure.

A parking lot server 300 may monitor that a personal mobility device 200 of FIG. 1 enters a predetermined radius from a parking lot through short range communication with the personal mobility device 200 and may transmit parking lot entrance information of the personal mobility device 200 to a parking recognition server 100 of FIG. 1. In this case, the parking lot entrance information may be used to transmit a device ID and entrance time information of the personal mobility device 200 to the parking recognition server 100.

Referring to FIG. 4, the parking lot server 300 may include a communication device 310, a storage 320, an Internet of things (IoT) sensor 330, and a processor 340.

The communication device 310 may perform wired communication, wireless communication, or short range communication. Examples of the short range communication technology and the wireless communication technology may be the same as those in the communication devices 110 and 210 described above.

As an example, the communication device 310 may perform Bluetooth communication with the personal mobility device 200 to receive a device ID of the personal mobility device 200. Furthermore, the communication device 310 may transmit a device ID of a personal mobility device which enters a parking lot to the parking recognition server 100. Furthermore, the communication device 310 may transmit information about a parking possible space in the parking lot to the parking recognition server 100. Thus, the parking recognition server 100 may recognize the information about the parking possible space to perform a parking pre-booking.

The storage 320 may store data, an algorithm, and/or the like necessary for an operation of the processor 340.

As an example, the storage 320 may store information for parking lot management.

The IoT sensor 330 may sense the personal mobility device 200 around the parking lot.

The processor 340 may perform the overall control of the parking lot server 300.

A user terminal 400 of FIG. 1 may include all mobile communication terminals, such as a smartphone, a table personal computer (PC), a pad, a personal digital assistant (PDA), a wearable device, and a laptop, which are capable of being carried. The user terminal 400 may install an application for renting or returning the personal mobility device 200 and may download the application from a center which manages the parking recognition server 100 or the personal mobility device 200.

Figure 8:
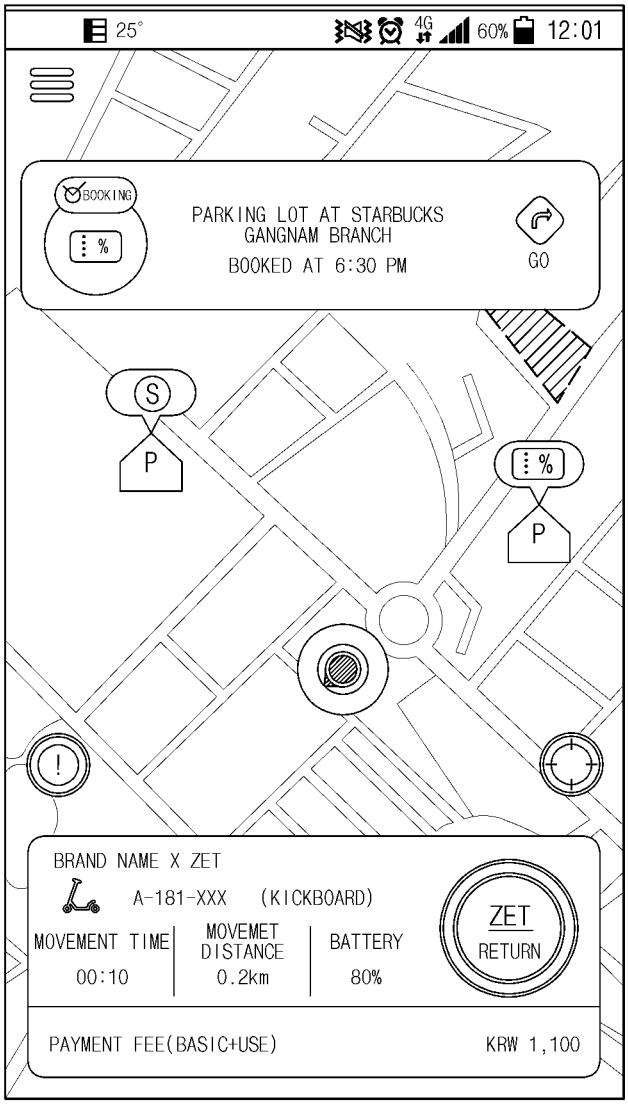
FIG. 8 is a drawing illustrating an exemplary screen where a parking pre-booking is completed, which is displayed on a display of a user terminal, in some forms of the present disclosure.

FIG. 8 is a drawing illustrating an exemplary screen where a parking pre-booking is completed, which is displayed on a display of a user terminal, in some forms of the present disclosure. As shown in FIG. 8, a user terminal 400 of FIG. 1 may predict a parking lot mainly used in a corresponding time when renting a personal mobility device 200 to automatically book the parking lot in advance and may display corresponding information in an app.

Figure 9:
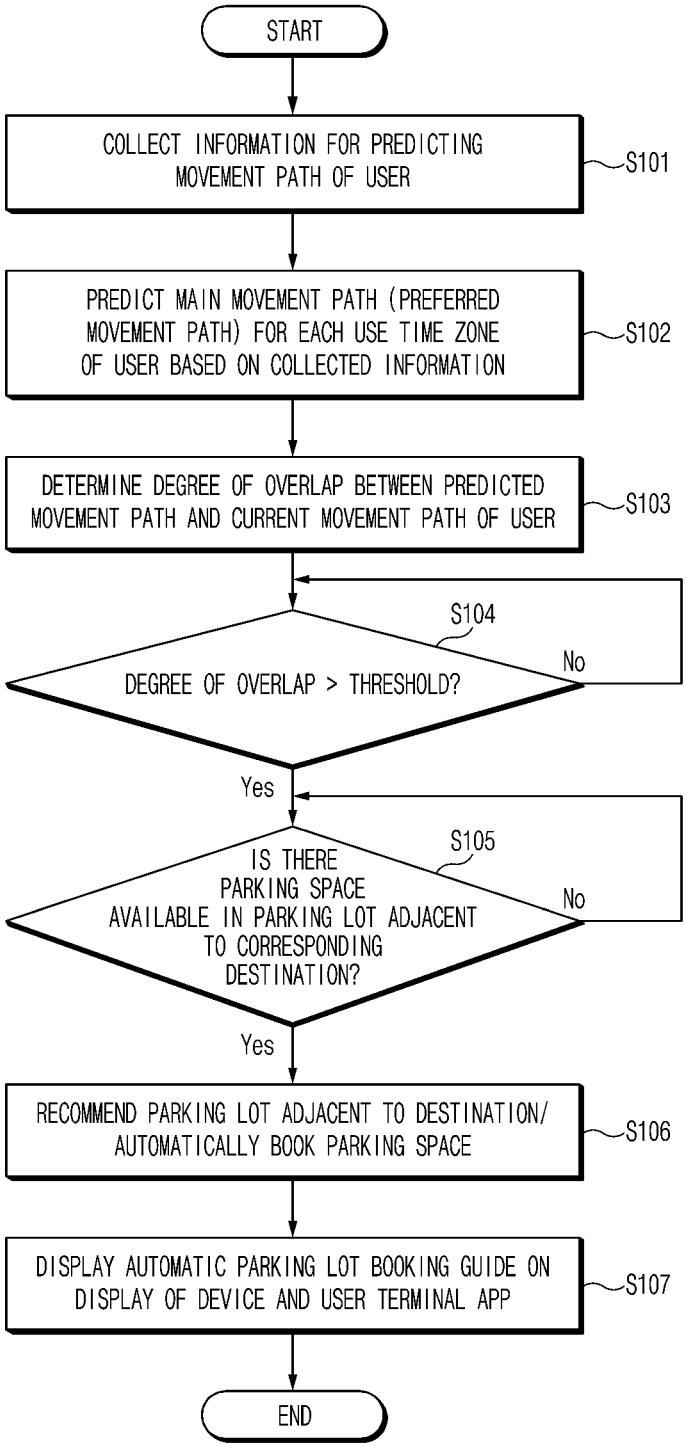
FIG. 9 is a flowchart illustrating a method for pre-booking parking of a personal mobility device in some forms of the present disclosure.

Hereinafter, a description will be given in detail of a method for pre-booking parking of a personal mobility device in some forms of the present disclosure with reference to FIG. 9. FIG. 9 is a flowchart illustrating a method for pre-booking parking of a personal mobility device in some forms of the present disclosure.

Hereinafter, it is assumed that a parking recognition server 100 of FIG. 2 performs a process of FIG. 9. Furthermore, in a description of FIG. 9, an operation described as being performed by a parking recognition server 100 may be understood as being controlled by a processor 140 of the parking recognition server 100.

Referring to FIG. 9, when a personal mobility device 200 of FIG. 1 starts to travel, in S101, the parking recognition server 100 may collect information for predicting a movement path of a user. In this case, the information for predicting the movement path of the user may include information about the user, information about a main use time of the user, starting point/destination search information of the user, information about a main use path of the user, or the like.

In S102, the parking recognition server 100 may predict a main movement path (a preferred movement path) for each use time zone of the user using history information based on the collected information. For example, when user A uses a path from the home to the library between from 1 p.m. to 1:30 p.m. every day, the parking recognition server 100 may predict a destination of user A as the library, when the starting point is the home and the starting time is 1 p.m. among the collected information, to predict a movement path from the home to the library.

In S103, the parking recognition server 100 may determine a degree of overlap between the predicted movement path and a current movement path of the user. In S104, the parking recognition server 100 may determine whether the degree of overlap is greater than a predetermined threshold. When the degree of overlap is greater than the predetermined threshold, in S105, the parking recognition server 100 may determine whether there is a parking space available in a parking lot adjacent to the destination.

When there is the parking space available in the parking lot adjacent to the destination, in S106, the parking recognition server 100 may recommend a user terminal 400 or the personal mobility device 200 to the parking lot adjacent to the destination and may automatically book the parking space.

In S107, the parking recognition server 100 may provide the user terminal 400 or the personal mobility device 200 with an automatic parking booking guide. When the automatic booking is completed, as shown in FIGS. 7 and 8, the user terminal 400 or the personal mobility device 200 may output a booking completion screen.

As such, the parking recognition server 100 in some forms of the present disclosure may collect data, such as destination search information, use time information, or a movement path for each user, may predict a movement path with respect to a main use time when the personal mobility device 200 is used for each user to estimate a final destination, may assign priorities in an order where a degree of overlap is high by comparing predicted movement paths of users for each time zone with real movement paths, and may compare demands of users having high priorities with the number of parking spaces available in a parking lot around the destination to perform automatic booking. Thus, some forms of the present disclosure may automatically book a parking space in advance to efficiently park the personal mobility device 200 based on the necessary amount of demand for parking and may guide personal mobility devices to be automatically arranged.

Figure 10:
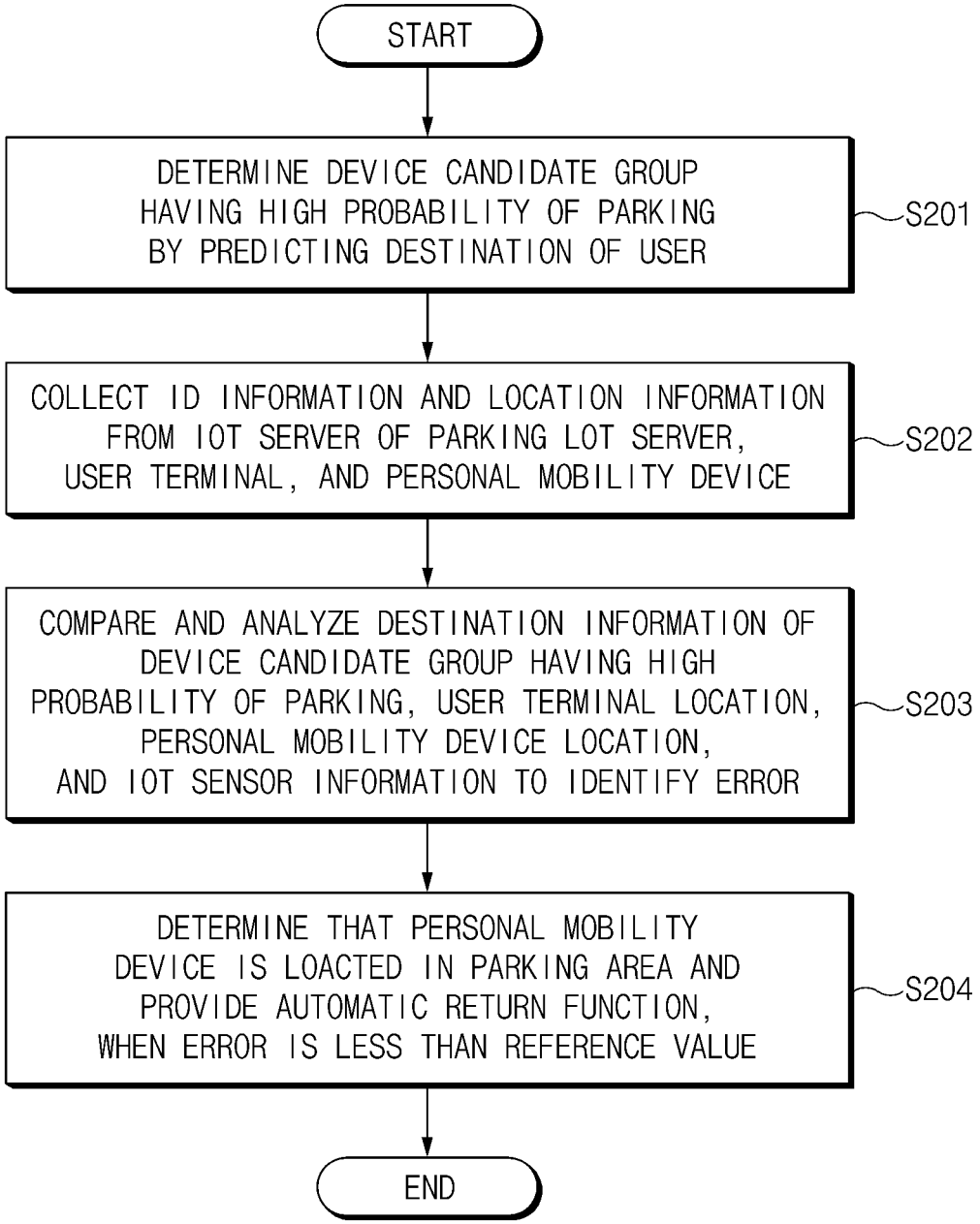
FIG. 10 is a flowchart illustrating a method for recognizing a parking location of a personal mobility device in some forms of the present disclosure.

Hereinafter, a description will be given in detail of a method for recognizing a parking location of a personal mobility device in some forms of the present disclosure with reference to FIG. 10. FIG. 10 is a flowchart illustrating a method for recognizing a parking location of a personal mobility device in some forms of the present disclosure.

Hereinafter, it is assumed that a parking recognition server 100 of FIG. 2 performs a process of FIG. 10. Furthermore, in a description of FIG. 10, an operation described as being performed by a parking recognition server 100 may be understood as being controlled by a processor 140 of the parking recognition server 100.

Referring to FIG. 10, in S201, the parking recognition server 100 may determine a device candidate group having a high probability of being parked by predicting a destination of a user. In this case, as shown in S101 to S103 of FIG. 9 described above, the parking recognition server 100 may determine a personal mobility device 200 as a device having a higher probability of being parked as a degree of overlap is higher depending on the degree of overlap based on a history and a predicted movement path for each user to determine a certain upper percentage of a candidate group.

In S202, the parking recognition server 100 may collect ID information and location information from an IoT sensor 330 of a parking lot server 300 of FIG. 4, a user terminal 400 of FIG. 1, and the personal mobility device 200. As shown in FIG. 5, the parking recognition server 100 may collect device ID information and location information from the IoT sensor 330 of the parking lot server 300 and the personal mobility device 200 and the user terminal 400, which enter a certain range with respect to the IoT sensor 330.

In S203, the parking recognition server 100 may compare and analyze destination information of a device candidate group having a high possibility of being parked, a user terminal location, a personal mobility device location, and a device location by IoT sensor information to analyze an error. In other words, as shown in FIG. 6, when a location of a user terminal, a location of a personal mobility device, and device location information received from an IoT sensor are similar to each other, for example, when an error range is less than a predetermined reference value (e.g., 0.5 m), the parking recognition server 100 may determine that the personal mobility device is normally parked in a parking area.

Thus, in S204, when the error is less than the reference value, the parking recognition server 100 may determine that the personal mobility device 200 is located in the parking area to provide an automatic return function. In this case, the user may manually perform return processing by means of the user terminal 400, but the parking recognition server 100 may automatically perform return processing when accurately determining whether the personal mobility device 200 is parked.

As such, some forms of the present disclosure may predict a destination for each time zone by analyzing a usage history of the personal mobility device 200 of the user and may reduce a target range to a device candidate group having a high probability of being parked to enhance accuracy. Furthermore, some forms of the present disclosure may determine ① a device candidate group having a high probability of being parked, ② a location of the user terminal 400, ③ a location of the personal mobility device 200, ④ device information in a radius of the IoT sensor 330 of the parking lot in an overall manner, and the like and may recognize that the personal mobility device 200 is normally parked in a parking area, when an error range between ①, ②, ③, and ④ is less than or equal to a specific numerical value to automatically return the personal mobility device 200.

Figure 11:
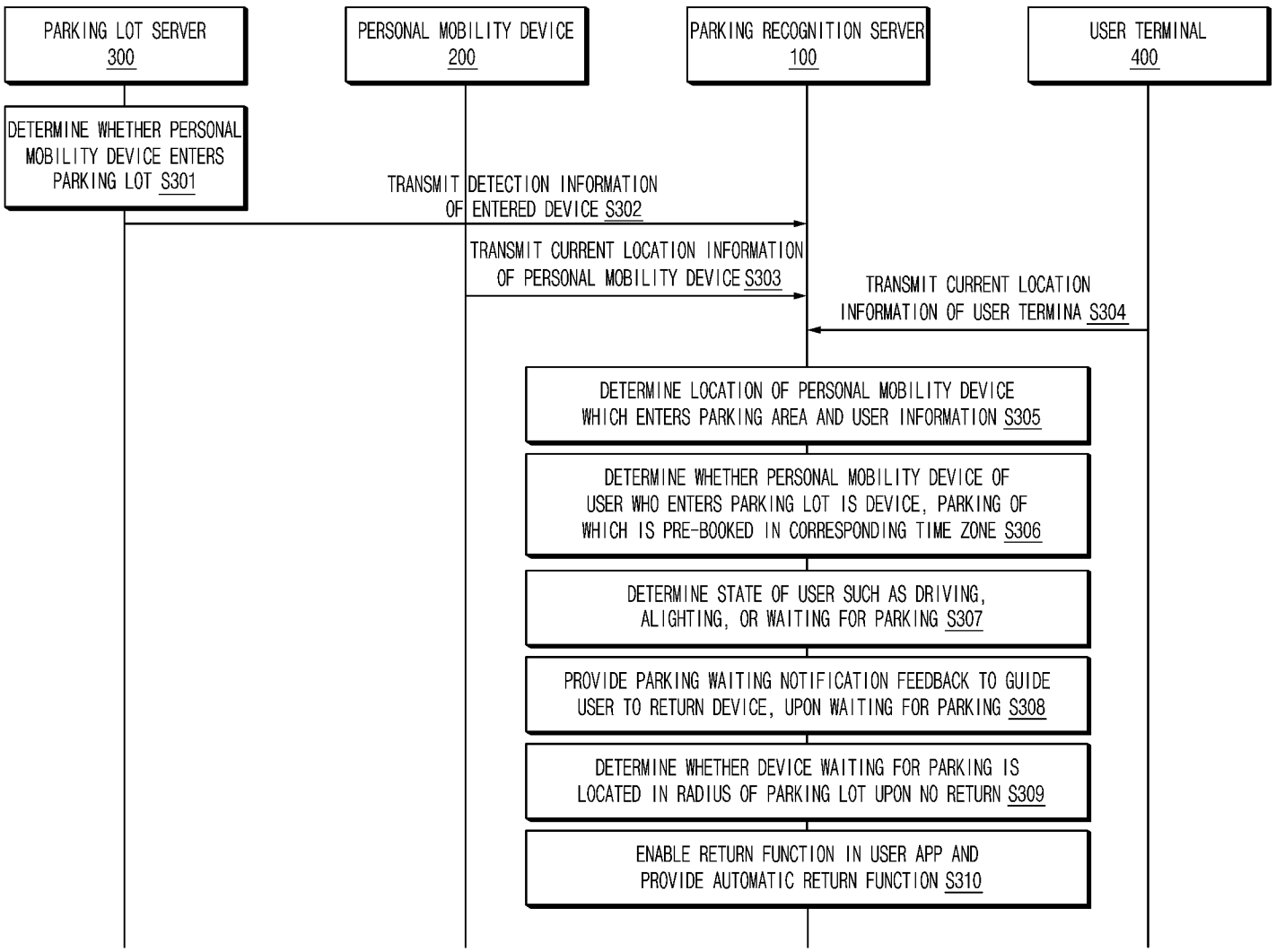
FIG. 11 is a signal sequence diagram illustrating in detail a method for recognizing a parking location of a personal mobility device in some forms of the present disclosure.

Hereinafter, a description will be given in detail of a method for recognizing a parking location of a personal mobility device in some forms of the present disclosure with reference to FIG. 11. FIG. 11 is a signal sequence diagram illustrating in detail a method for recognizing a parking location of a personal mobility device in some forms of the present disclosure.

Hereinafter, it is assumed that a processor of each of a parking recognition server 100, a personal mobility device 200, a parking lot server 300, and a user terminal 400 of FIG. 1 performs a process of FIG. 11.

Referring to FIG. 11, in S301, the parking lot server 300 may monitor whether the personal mobility device 200 enters a parking lot. In S302, the parking lot server 300 may transmit sensing information (e.g., an ID) of the personal mobility device 200 which enters the parking lot to the parking recognition server 100. An IoT server 300 of the parking lot server 300 may detect entrance of the personal mobility device 200 through Bluetooth communication.

In S303, the personal mobility device 200 may transmit current location information of the personal mobility device 200 to the parking recognition server 100. In this case, the personal mobility device 200 may transmit its location to the parking recognition server 100 at a predetermined period or whenever a change in location occurs.

In S304, the parking recognition server 100 may transmit current location information of the user terminal 400. In this case, the user terminal 400 may transmit its location to the parking recognition server 100 at a predetermined period or whenever a change in location occurs.

In S305, the parking recognition server 100 may determine a location of the personal mobility device 200 which enters a parking area and user information of the user of the personal mobility device 200. In this case, the user information may include personal information, previous usage history, or the like.

In S306, the parking recognition server 100 may determine whether the personal mobility device 200 of the user which enters the parking lot is a device, parking of which is pre-booked in a corresponding time zone.

In S307, the parking recognition server 100 may determine a state of the personal mobility device 200, that is, a state where the user rides in the personal mobility device 200, alights from the personal mobility device 200, or waits for parking the personal mobility device 200.

The parking recognition server 100 may determine whether the user is riding in the personal mobility device 200, is traveling on the personal mobility device 200, is alighting from the personal mobility device 200, or waits for riding in the personal mobility device 200. For example, when the speed of the personal mobility device 200 is 0 km/s and when the load of the personal mobility device 200 is 0 kg, the parking recognition server 100 may determine that the user alights from the personal mobility device 200. When the speed of the personal mobility device 200 is 0 km/s and when the load of the personal mobility device 200 is 60 kg, the parking recognition server 100 may determine that the user waits for parking the personal mobility device 200 without alighting from the personal mobility device 200. When the speed of the personal mobility device 200 is 10 km/s and when the load of the personal mobility device 200 is 60 kg, the parking recognition server 100 may determine that the user rides in the personal mobility device 200.

In S308, when the user waits for parking the personal mobility device 200, the parking recognition server 100 may provide the personal mobility device 200 with parking waiting notification feedback to guide the user to return the personal mobility device 200.

In S309, when the user does not return the personal mobility device 200, the parking recognition server 100 may determine whether the personal mobility device 200 which is waiting for parking is located in a radius of the parking lot. In this case, as shown in S201 to S204 of FIG. 10, the parking recognition server 100 may compare and analyze destination information of a device candidate group having a high probability of being parked, a user terminal location, a personal mobility device location, and a device location by IoT sensor information to identify an error, thus accurately detecting whether the personal mobility device 200 is located in the radius of the parking lot.

When it is determined that the personal mobility device 200 is parked in the parking area, in S310, the parking recognition server 100 may enable a return function in an app of the user terminal 400 and may provide an automatic return function.

As such, some forms of the present disclosure may recognize an accurate parking space using a user prediction model based on an analysis of a use pattern of the personal mobility device 200 for each user, location information of the IoT sensor 330 of the parking lot, location information of the user terminal 400, and location information of the personal mobility device 200, thus creating a more appropriate parking culture and efficiently managing a parking area.

Figure 12:
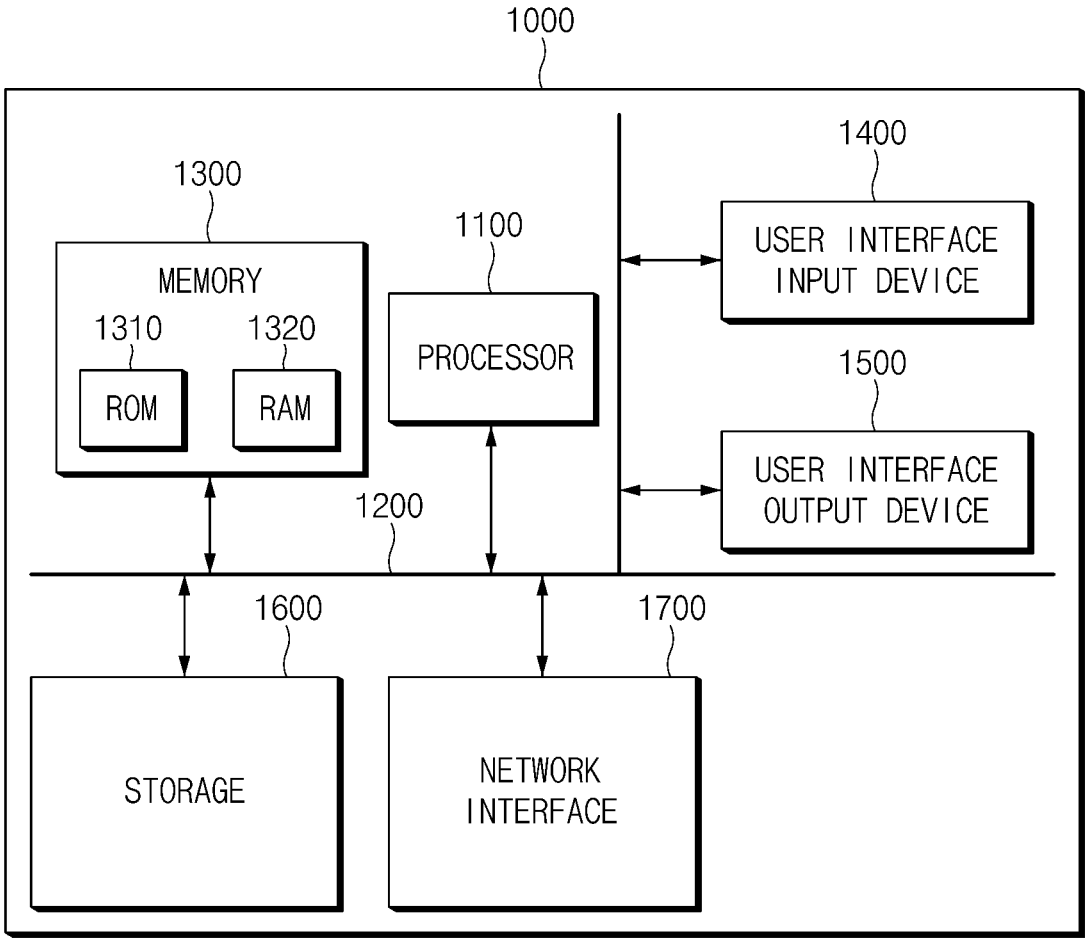
FIG. 12 is a block diagram illustrating a computing system in some forms of the present disclosure.

FIG. 12 is a block diagram illustrating a computing system in some forms of the present disclosure.

Referring to FIG. 12, a computing system 1000 may include at least one processor 1100, a memory 1300, a user interface input device 1400, a user interface output device 1500, storage 1600, and a network interface 1700, which are connected with each other via a bus 1200.

The processor 1100 may be a central processing unit (CPU) or a semiconductor device that processes instructions stored in the memory 1300 and/or the storage 1600. The memory 1300 and the storage 1600 may include various types of volatile or non-volatile storage media. For example, the memory 1300 may include a read only memory (ROM) 1310 and a random access memory (RAM) 1320.

Thus, the operations of the method or the algorithm described in some forms of the present disclosure may be embodied directly in hardware or a software module executed by the processor 1100, or in a combination thereof. The software module may reside on a storage medium (that is, the memory 1300 and/or the storage 1600) such as a RAM, a flash memory, a ROM, an EPROM, an EEPROM, a register, a hard disk, a removable disk, and a CD-ROM.

The exemplary storage medium may be coupled to the processor, and the processor may read information out of the storage medium and may record information in the storage medium. Alternatively, the storage medium may be integrated with the processor 1100. The processor and the storage medium may reside in an application specific integrated circuit (ASIC). The ASIC may reside within a user terminal. In another case, the processor and the storage medium may reside in the user terminal as separate components.

The present technology may determine an accurate parking location of the personal mobility device and may automatically return the personal mobility device, thus efficiently managing parking of the personal mobility device.

The present technology may predict a destination and a movement path based on a history for each user of the personal mobility device and may pre-book parking in a parking lot of the predicted destination based on the predicted destination and the predicted movement path, thus facilitating smooth parking and increasing convenience of the user.

In addition, various effects ascertained directly or indirectly through the present disclosure may be provided.

Hereinabove, although the present disclosure has been described in some forms and the accompanying drawings, the present disclosure is not limited thereto, but may be variously modified and altered by those skilled in the art to which the present disclosure pertains without departing from the spirit and scope of the present disclosure claimed in the following claims.

Therefore, the exemplary forms of the present disclosure are provided to explain the spirit and scope of the present disclosure, but not to limit them, so that the spirit and scope of the present disclosure is not limited by the forms of the present disclosure. The scope of the present disclosure should be construed on the basis of the accompanying claims, and all the technical ideas within the scope equivalent to the claims should be included in the scope of the present disclosure.

What is claimed is:

1. A parking recognition server, comprising:

a processor configured to determine whether a personal mobility device is parked in a parking area; and a storage configured to store data and an algorithm run by the processor and a usage history for each user who uses the personal mobility device, wherein the processor is configured to:

predict a destination and a movement path of a user for the usage history for each user; and determine a device candidate group having a high probability of being parked in the predicted destination based on a degree of overlap between the predicted movement path and an actual movement path of the user.

2. The parking recognition server of claim 1, further comprising:

a communication device configured to communicate with a user terminal, a parking lot server, or the personal mobility device.

3. The parking recognition server of claim 1, wherein the processor is configured to:

collect at least one of information about the user, information about a main use time of the user, starting point or destination search information of the user, or information about a main use path of the user, when the personal mobility device is traveling; and reflect the collected information in the usage history for each user.

4. The parking recognition server of claim 3, wherein the processor is configured to:

compare a main movement path of the user in a main use time zone of the user in the usage history for each user with the actual movement path of the user; and determine that the personal mobility device is a device having a high probability of parking in the predicted destination when a degree of overlap between the main movement path and the actual movement path is greater than or equal to a predetermined threshold.

5. The parking recognition server of claim 4, wherein the processor is configured to:

perform an automatic parking booking in a parking lot around the predicted destination, when the personal mobility device is determined to be the device having the high probability of parking in the predicted destination.

6. The parking recognition server of claim 4, wherein the processor is configured to:

determine whether there is a parking lot around the predicted destination, when the personal mobility device is determined to be the device having the high probability of parking in the predicted destination;

determine whether there is a parking space in the parking lot around the predicted destination, when there is the parking lot around the predicted destination; and provide a user terminal or the personal mobility device with an automatic booking guide, when it is determined that there is the parking space.

7. The parking recognition server of claim 1, wherein the processor is configured to:

determine a location of the personal mobility device based on:

a location of a device having a high probability of parking in the predicted destination, a location of a user terminal received from the user terminal of the user who is using the personal mobility device, a location of the personal mobility device received from the personal mobility device, and a location of the personal mobility device which enters a parking lot.

8. The parking recognition server of claim 7, wherein the processor is configured to:

compare the location of the device having the high probability of parking in the predicted destination, the location of the user terminal received from the user terminal of the user who is using the personal mobility device, the location of the personal mobility device received from the personal mobility device, and the location of the personal mobility device which enters the parking lot; and determine that the personal mobility device is normally parked in a parking area of the parking lot, when an error is less than a predetermined reference value.

9. The parking recognition server of claim 1, wherein the processor is configured to:

automatically return the personal mobility device, when it is determined that the personal mobility device is normally parked in a parking area of a parking lot.

10. The parking recognition server of claim 1, wherein the processor is configured to:

determine whether a personal mobility device is a device, when information of the personal mobility device which enters the parking lot is received from a parking lot server, wherein parking is reserved in a parking lot.

11. The parking recognition server of claim 10, wherein the processor is configured to:

determine whether the personal mobility device is traveling, whether the user leaves from the personal mobility device, or whether the personal mobility device waits for parking.

12. The parking recognition server of claim 10, wherein the processor is configured to:

determine a state of the personal mobility device based on at least one of a speed, a load, a sound detection result, or global positioning system (GPS) location information of the personal mobility device.

13. The parking recognition server of claim 10, wherein the processor is configured to:

determine whether the personal mobility device is traveling or is in a parked state based on acceleration or deceleration of the personal mobility device;

determine whether the user rides or leaves from the personal mobility device depending on a time when a load of the personal mobility device is reduced or depending on whether a location of a user terminal is identical to a location of the personal mobility device; and determine whether the user leaves from the personal mobility device depending on whether an alarm sound of the personal mobility device is output.

14. The parking recognition server of claim 11, wherein the processor is configured to:

provide a user terminal or the personal mobility device with parking waiting notification feedback, when it is determined that the personal mobility device waits for parking.

15. A parking recognition system, comprising:

a personal mobile device;

a user terminal of a user who is using the personal mobility device;

a parking lot server configured to detect that the personal mobility device enters a parking lot; and a parking recognition server configured to:

predict a destination and a movement path of the user for a usage history for each user;

determine a device candidate group having a high probability of parking in the predicted destination based on a degree of overlap between the predicted movement path and an actual movement path of the user; and determine a location of the personal mobility device using a location of a device having a high probability of parking in the predicted destination, a location of the user terminal received from the user terminal, a location of the personal mobility device received from the personal mobility device, or a location of the personal mobility device which enters a parking lot.

16. A parking recognition method, comprising:

predicting, by a processor, a destination and a movement path of a user based on a usage history for each user of a personal mobility device;

determining, by the processor, a device candidate group having a high probability of parking in the predicted destination based on a degree of overlap between the predicted movement path and an actual movement path of the user; and determining a location of the personal mobility device using a location of a device having a high probability of parking in the predicted destination, a location of a user terminal received from the user terminal of the user who is using the personal mobility device, a location of the personal mobility device received from the personal mobility device, or a location of the personal mobility device which enters a parking lot.

17. The parking recognition method of claim 16, further comprising:

when the personal mobility device is traveling, collecting at least one of information about the user, information about a main use time of the user, starting point or destination search information of the user, or information about a main use path of the user; and reflecting the collected information in the usage history for each user.

18. The parking recognition method of claim 16, further comprising:

comparing the location of the device having the high probability of being parked in the predicted destination, the location of the user terminal received from the user terminal of the user who is using the personal mobility device, the location of the personal mobility device received from the personal mobility device, and the location of the personal mobility device which enters the parking lot, the location being received from the parking lot server; and determining that the personal mobility device is normally parked in a parking area of the parking lot when an error is less than a predetermined reference value.

19. The parking recognition method of claim 16, further comprising:

when it is determined that the personal mobility device is the device having the high probability of parking in the predicted destination, performing an automatic parking booking in a parking lot around the predicted destination.

20. The parking recognition method of claim 16, further comprising:

when it is determined that the personal mobility device is normally parked in a parking area of the parking lot, automatically returning the personal mobility device.

* * * * *